US009738404B2

(12) United States Patent
Koster et al.

(10) Patent No.: US 9,738,404 B2
(45) Date of Patent: Aug. 22, 2017

(54) DEVICE AND METHOD FOR FOLDING OUTER PACKAGING

(71) Applicant: KHS GmbH, Dortmund (DE)

(72) Inventors: Christoph Koster, Kleve (DE); Reinhard Wilzeck, Kleve (DE)

(73) Assignee: KHS GmbH, Dortmund (DE)

( * ) Notice: Subject to any disclaimer, the term of this patent is extended or adjusted under 35 U.S.C. 154(b) by 624 days.

(21) Appl. No.: 14/222,793

(22) Filed: Mar. 24, 2014

(65) Prior Publication Data

US 2014/0290178 A1 Oct. 2, 2014

(30) Foreign Application Priority Data

Mar. 22, 2013 (DE) ..... 10 2013 102 986

(51) Int. Cl.

| | |
|---|---|
| ***B65B 11/00*** | (2006.01) |
| ***B65B 21/00*** | (2006.01) |
| ***B65B 21/24*** | (2006.01) |
| ***B65B 43/08*** | (2006.01) |
| ***B65B 49/02*** | (2006.01) |
| ***B65B 49/12*** | (2006.01) |
| ***B65B 49/14*** | (2006.01) |
| ***B65B 59/00*** | (2006.01) |

(52) U.S. Cl.

CPC ..... *B65B 11/004* (2013.01); *B65B 21/00* (2013.01); *B65B 21/24* (2013.01); *B65B 43/08* (2013.01); *B65B 49/02* (2013.01); *B65B 49/12* (2013.01); *B65B 49/14* (2013.01); *B65B 59/00* (2013.01)

(58) Field of Classification Search

CPC ... B31B 1/54; B31B 2201/2675; B65B 21/24; B65D 5/24; B65D 5/241

USPC ..... 53/48.7, 207, 398

See application file for complete search history.

(56) References Cited

U.S. PATENT DOCUMENTS

| | | | | |
|---|---|---|---|---|
| 3,516,219 | A | 6/1970 | Nigrelli et al. | |
| 3,543,474 | A | 12/1970 | Hasselo et al. | |
| 3,681,893 | A * | 8/1972 | De Barge | B65B 49/14 53/209 |
| 3,701,231 | A | 10/1972 | Standley | |
| 4,460,349 | A * | 7/1984 | Charron | B31B 1/00 493/131 |
| 4,642,967 | A * | 2/1987 | Culpepper | B65B 35/44 198/419.1 |

(Continued)

FOREIGN PATENT DOCUMENTS

| | | |
|---|---|---|
| EP | 0 481 580 | 4/1992 |

*Primary Examiner* — Thanh Truong
*Assistant Examiner* — Patrick Fry
(74) *Attorney, Agent, or Firm* — Occhiuti & Rohlicek LLP

(57) ABSTRACT

An apparatus for at least partially folding outer packaging includes a conveyor that transports the outer packaging, a first folder, a second folder, and a set of one or more rotating folders that are part of the second folder. The first folders swivel on the conveyor and fold a front side segment of the outer package that adjoins its base segment and connecting segments that are hinged relative to the base segment. The second folders are above the conveyor device and are configured to fold connecting segments that are hinged relative to the base segment of the outer package. The second folders act on the front side segment of the outer package in a direction oriented against an effective direction of the first folding device around a fold line running in the particular connecting segments.

19 Claims, 3 Drawing Sheets

(56) References Cited

U.S. PATENT DOCUMENTS

| | | | | | |
|---|---|---|---|---|---|
| 4,887,414 | A * | 12/1989 | Arena | B65B 21/24 | 198/418.7 |
| 5,041,070 | A * | 8/1991 | Blaser | B26D 5/005 | 226/27 |
| 5,827,162 | A * | 10/1998 | Rubin | B31B 1/00 | 493/178 |
| 7,309,307 | B2 * | 12/2007 | Baenninger | B31B 1/00 | 493/10 |
| 7,611,042 | B2 * | 11/2009 | Bates | B65D 5/0005 | 206/427 |
| 8,246,527 | B2 * | 8/2012 | Wilkinson | B31B 1/00 | 493/162 |
| 2009/0170678 | A1 * | 7/2009 | Smith | B31B 1/00 | 493/51 |
| 2012/0297736 | A1 * | 11/2012 | Ausnit | B65B 43/265 | 53/456 |
| 2013/0026059 | A1 * | 1/2013 | Jenkins | B65D 5/242 | 206/503 |

* cited by examiner

DEVICE AND METHOD FOR FOLDING OUTER PACKAGING

RELATED APPLICATIONS

Under 35 USC 119, this application claims the benefit of the Mar. 22, 2013 priority date of German application DE 10 2013 102 986.8, the contents of which are herein incorporated by reference in their entirety.

FIELD OF INVENTION

The invention concerns packaging machines, and in particular, packaging machines for at least partially folding of outer packaging.

BACKGROUND

It is known to use wrap-around cartons, also called icepack cartons, to hold containers, bottles, or cans filled with drinks. The icepack cartons are torn partially open at the top by the end consumer and filled with ice to cool the containers or the liquid held in the containers.

Conventional carton packaging is not suitable for these applications because they do not form watertight outer packaging. Because of cuts present in the carton blank, they necessarily have leakage points in the unfolded state. As ice melts, melt water can escape through these leakage points. A leakage of melt water such as this is extremely unwelcome.

In contrast, icepack cartons are made from self-contained carton blanks that do not have any cuts of this kind in the carton blank. To be able to fold closed carton blanks of this kind, a multiplicity of fold lines are provided. This is carried out, for example, by pre-stamping fold lines in the carton blank. Subsequent folding can then take place along these fold lines.

Icepack cartons of this kind have a base segment that, in the folded state, forms the base of the outer packaging. Drink containers held in the outer packaging stand on this base. A front side segment, a rear side segment, and two lateral surface sections opposite each other make the lateral surfaces of the icepack carton.

Connecting segments are provided between the segments adjoining each other in the folded state, for example the front side segment and a lateral surface segment. These connecting segments effect a closed connection of the segments actually adjoining each other. The connecting segments have one side hinged onto the particular segment to which they are adjoining. These hinge points run at right angles to each other in the unfolded state of the carton blank. Moreover, in the connecting segment, a further folding line runs, for example, at a 45° angle to the aforesaid hinge points. Around this fold line, when the carton blank is folded, a folding of the connecting segment occurs in such a way that the two connecting segment areas separated from each other by the fold line come to rest flat against each other at least partially. In this way, the forming of closed outer packaging corners is possible.

A disadvantage of forming the outer packaging from one self-contained blank is that it is difficult to fold. As a result, automated folding of the carton blanks to form the desired outer packaging is possible only with difficulty. Hitherto, the folding of outer packaging of this kind has been carried out manually. This results in low processing speed and high costs.

SUMMARY

The invention features a device for the at least partial folding of outer packaging that makes an automated folding of icepack cartons possible and that can also be adapted in particular for the processing of different outer packaging formats.

In one aspect, the invention features an apparatus for at least partially folding outer packaging that has multiple segments connected by fold lines, and that has a base segment. Such an apparatus includes a conveyor device, a first folding device, a second folding device, and a set of one or more rotating folders. The conveyor device transports the outer packaging in a direction-of-transport in a position in which the base segment of the outer packaging rests on the conveyor device. The first folding devices are arranged on the conveyor device such that the first folding devices swivel. The first folding devices are configured for folding of a front side segment of the outer package that adjoins the base segment of the outer package and connecting segments that are hinged relative to the base segment of the outer package. The second folding devices are provided above the conveyor device. The second folding devices are configured to effect a folding of the connecting segments that are hinged relative to the base segment of the outer package and to act on the front side segment of the outer package in a direction that is oriented against an effective direction of the first folding device around a fold line running in the particular connecting segments. The rotating folder, which is a constituent element of the second folding devices, is driven to rotate about an axis of rotation.

Some embodiments include a servo-motor that drives the rotating folder.

Among these embodiments are those that also include a control system interacting with the servomotor. These include embodiments in which the control system is programmed and configured trigger the servo-motor with a speed profile that depends on a format of the outer packaging, embodiments in which the control system is programmed and configured trigger the servo-motor with an angular acceleration profile that depends on a format of the outer packaging, and embodiments in which the control system is programmed and configured trigger the servomotor with a rotary motion profile that depends on a format of the outer packaging, including embodiments in which the control system is further configured to change a direction of rotation of the at least one rotating folder.

Also among the embodiments that include a servomotor are those having both a control system and a storage device. The storage device is configured to have stored therein a parameter set. The parameter set has different format-dependent parameters for triggering the servo-motor.

Other embodiments include a shaft. In these embodiments, the rotating folder is arranged on the shaft and has two rotating-folder segments that extend radially opposite each other. In some of these embodiments, the rotating-folder segments comprise flat material.

In some embodiments, the set of one or more rotating folders includes at least two rotating folders. Among these embodiments are those that further include a shaft on which the rotating folders are arranged so that they can be moved axially, and also those in which a distance of the rotating folders relative to the conveyor device is adjustable.

In another aspect, the invention features a method for at least partially folding outer packaging that has multiple segments connected by fold lines. Such a method includes resting a base segment of the outer packaging on a conveyor device; using the conveyor device, moving the outer packaging in a direction-of-transport; using first folding devices that are arranged to swivel on the conveyor device, folding a front side segment adjoining the base segment and connecting segments hinged on the front side segment relative to the base segment; and using second folding devices that are provided above the conveyor device and that have rotating folders that are driven to rotate about an axis of rotation, folding the connecting segments about a fold line running in the particular connecting segments by acting on the front side segment in a direction oriented against the effective direction of the first folding device.

Some practices also include driving the rotating folders using a servo-motor. Among these practices are practices that include selecting a speed profile that depends on the outer packaging, and driving the rotating fodders with the speed profile, practices that include selecting an angular acceleration profile that depends on the outer packaging, and driving the rotating fodders with the angular acceleration profile, practices that include selecting a rotary motion profile that depends on the outer packaging, and driving the rotating fodders with the rotary motion profile, and practices that include driving the rotating folders in an alternating direction of rotation.

In other practices, the method includes moving the rotating folders at least partially in spaces forming between containers arranged in rows in an area of the base segment of the outer packaging.

In another aspect, the invention features a device for the at least partial folding of outer packaging that has multiple segments connected by means of fold lines. Such a device comprises the following components: a conveyor device for transporting the outer packaging in a position with at least the base segment resting on the conveyor device in a direction of transport, first preparation means that are arranged on the conveyor device such that they can swivel and are made for the folding of a front side segment adjoining the base segment and connecting segments hinged on it relative to the base segment, and second preparation means that are provided above the conveyor device and are made so as to effect a folding of the connecting segments by acting on the front side segment in a direction oriented against the effective direction of the first preparation means, around a fold line running in the particular connecting segments, wherein the second preparation means have at least one folding means driven to rotate about an axis of rotation.

An advantage of a device according to the invention is that, after the folding of the front side segment and the connecting section hinged on to it relative to the base segment, due to the action of the second preparation means on the front side segment, a folding of the connecting segments inwards along the fold line running in the particular connecting segments is effected. Due to the rotating drive of the folding means about an axis of rotation, a targeted action on the front side segment is possible so that an optimum folding of the connecting segments is effected.

In some embodiments, the at least one folding means is driven by a servo-motor. Due to this servo-motor drive, it is possible to control the folding means specifically in its rotary movement so that a desired degree of folding of the connecting segments is achieved without damaging or tearing open the front side segment of the outer packaging. The degree of folding is limited absolutely by the surfaces of the folding tool on which the front side segment must come to rest.

Some embodiments include a control system interacting with the servo-motor. The control system is made to trigger the servo-motor with a speed profile depending on the format of the outer packaging and/or with an angular acceleration profile depending on the format of the outer packaging. In this way, it is possible to measure out the speed of impact of the folding means appropriately on the front side segment and in particular to exert a sudden pulse on the front side segment in such a way that a desired folding of the connecting segments occurs along the fold line.

In some embodiments, a control system interacting with the servo-motor is provided. The control system is made to trigger the servo-motor with a rotary motion profile depending on the format of the outer packaging.

As used herein, "rotary motion profile" means a certain time-dependent course of the speed or the angular acceleration of the drive shaft of the servo-motor so that depending on the angular position of the folding means, a desired speed or a desired angular acceleration of this folding means is achieved. In this way, it is possible, depending on the position of the outer packaging moved through the conveyor device in a direction of transport, to effect a targeted action on the front side segment for the folding of the connecting segments.

The control device preferably has a storage device or is provided with a storage device interacting with the control device. The storage device has a set of parameters with different format-dependent parameters for triggering the servo-motor. With different formats of the outer packaging, it is essential to change the action of the folding means on the front side segment appropriately to achieve an optimum folding of the connecting segments. Due to the program-controlled servo-drive by means of a parameter set that supplies, in each case, optimum parameters for the particular outer packaging formats to be processed, it is possible to provide short-term format changes with reproducible folding results.

In some embodiments, the control device is made to change the direction of rotation of the at least one folding means. In particular, the folding means can be driven in a clockwise direction of rotation or in an anti-clockwise direction of rotation. In this way, it is possible to process both the front side segment and also the rear side segment opposite the front side segment with the same folding means, this being in the opposite effective direction. In this way, it is possible to effect, in one pass, a folding of the connecting segments at the front in the direction of transport and the connecting segments at the rear in the direction of transport.

In some embodiments, the folding means are arranged on a shaft. The folding means have furthermore at least two folding means segments standing spaced radially apart on opposite sides. Due to the swivel arm rotating on a shaft, the propeller-like folding means are formed so that, with a full rotation of the shaft, two front side segments can be processed.

In some embodiments, the folding means segments are made of flat material. In particular, the folding means segments are made flat, wherein the level stretched by the folding means segments runs parallel or substantially parallel to the direction of transport and stands perpendicular or substantially perpendicular to the axial direction of the shaft. As a result, the narrow sides of the folding means segments act on the front side segment and the rear side segment, and the folding means segments can be moved, subject to an appropriate orientation of the folding means or appropriate arrangement on the shaft, through the spaces forming between containers arranged in rows in the area of the base segment. This makes possible a contact-free movement of the folding means through the inside of the outer packaging or the containers held in it.

In some embodiments, at least two folding means are provided. In this way, in the event of particularly narrowly designed folding means being used, damage to the front side segment or an unwanted folding of it at the point of action of the folding means can be prevented. In particular, thereby a locally distributed action on the front side segment is achieved.

In some embodiments, the folding means are arranged so that they can be moved axially on the shaft. In this way, an adaptation of the position of the folding means relative to the outer packaging or the containers inside it is possible so that a collision of the folding means with these containers is prevented.

In some embodiments, the distance of the folding means relative to the conveyor device can be adjusted. Due to the height adjustment of the folding means or of the second folding device, on the one hand an adaptation of the depth of action of the folding means is possible so that in particular different formats of outer packaging can be processed on the folding device. Moreover, it is possible for the second folding device to be positioned with its folding means above the conveyor device in such a way that the folding means come to lie above the outer packaging moved on the conveyor device so that conventional cartons can also be moved by means of the transport device.

In another aspect, the invention also features a method for the at least partial folding of outer packaging that has multiple segments connected by means of fold lines. Such a method includes moving the outer packaging by means of a conveyor device in a position with at least the base segment resting on the conveyor device in a direction of transport, folding of a front side segment adjoining the base segment and connecting segments hinged thereon relative to the base segment, by means of first preparation means that are arranged on the conveyor device such that they can swivel, folding of the connecting segments about a fold line running in the particular connecting segments by acting on the front side segment in a direction oriented against the effective direction of the first preparation means, by means of second preparation means, which are provided above the conveyor device and have folding means which are driven to rotate about an axis of rotation.

In some practices, the folding means are driven by a servo-motor. By the targeted triggering of the servo-motor, a desired action on the front side segment is possible such that a desired folding in the area of the connecting segments arises.

In some practices, the folding means are driven with a speed profile depending on the format of the outer packaging and/or with an angular acceleration profile depending on the format of the outer packaging. In this way it is possible to set the point of action or pulse of action of the folding means relative to the front side segment appropriately, this being in particular depending on the format of the outer packaging currently being processed.

In some practices, the folding means are driven with a rotary motion profile depending on the format of the outer packaging. In this way it is then possible to adapt the action of the folding means on the front side segment to the outer packaging being processed at the time or to its format.

In some practices of the invention, the folding means are driven in an alternating direction of rotation. Due to the change in the direction of rotation, it is not only possible to process the front side segment by means of the folding means but also the rear side segment opposite the front side segment so as to achieve there an at least partial folding of the connecting segments hinged on it.

In another practice of the invention, the folding means are moved at least partially in the spaces forming between containers arranged in rows in the area of the base segment of the outer packaging.

In another practice, the folding means are made narrow in such a way that a collision of the folding means with these containers is prevented by moving the folding means through the spaces. In this way, propeller-shaped folding means can be used which are optimized with regard to the action of impact on the front side segment or the rear side segment.

As used herein, the expression "substantially" or "approximately" means deviations from the exact value in each case by ±10%, and preferably by ±5% and/or deviations in the form of changes not significant for function.

Further developments, benefits and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE DRAWINGS

These and other features and advantages of the invention will be apparent from the following detailed description and the accompanying figures, in which.

DETAILED DESCRIPTION

Figure 1:
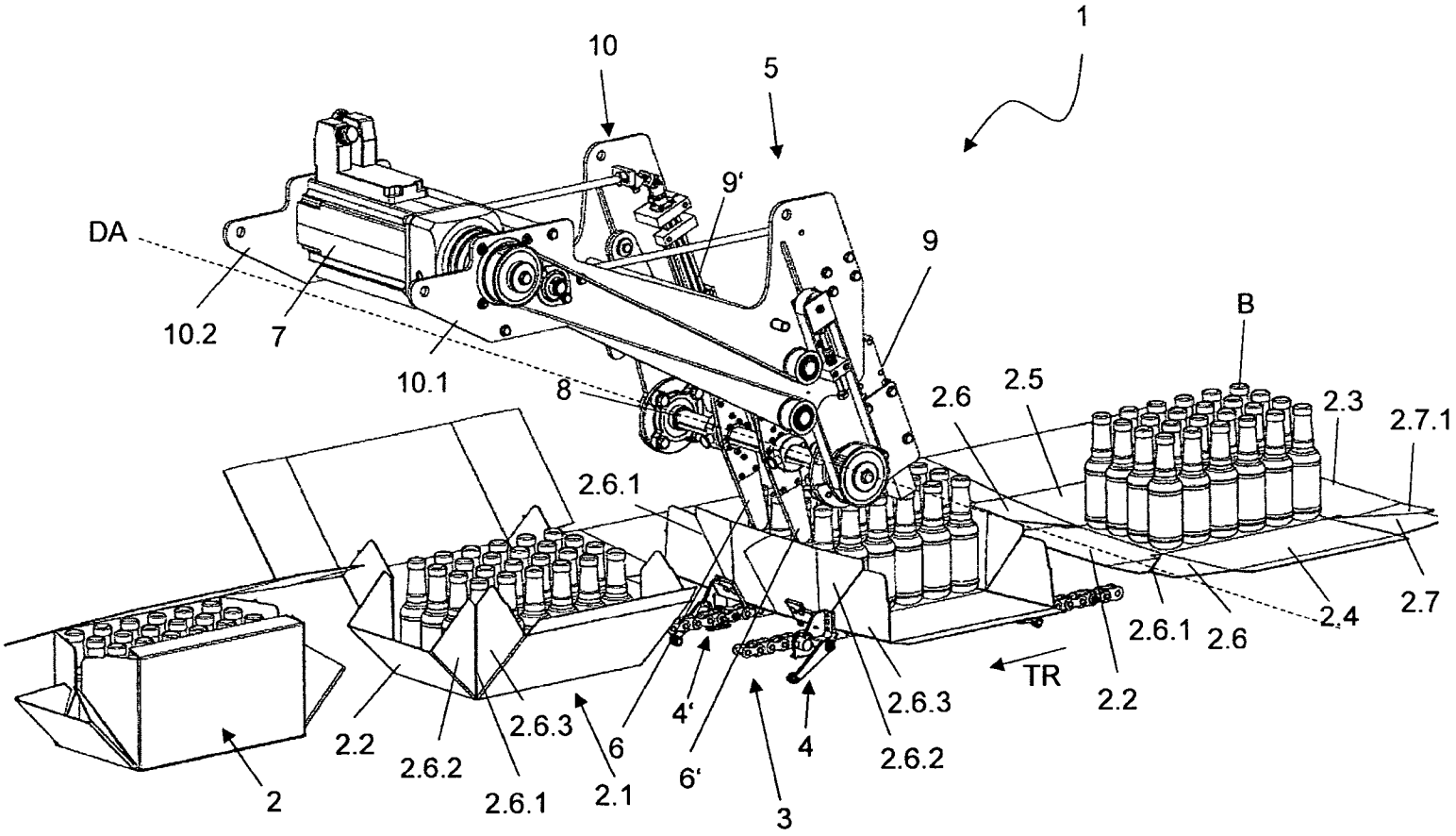
FIG. 1 shows a folding device according to the invention in a perspective view.
Figure 2:
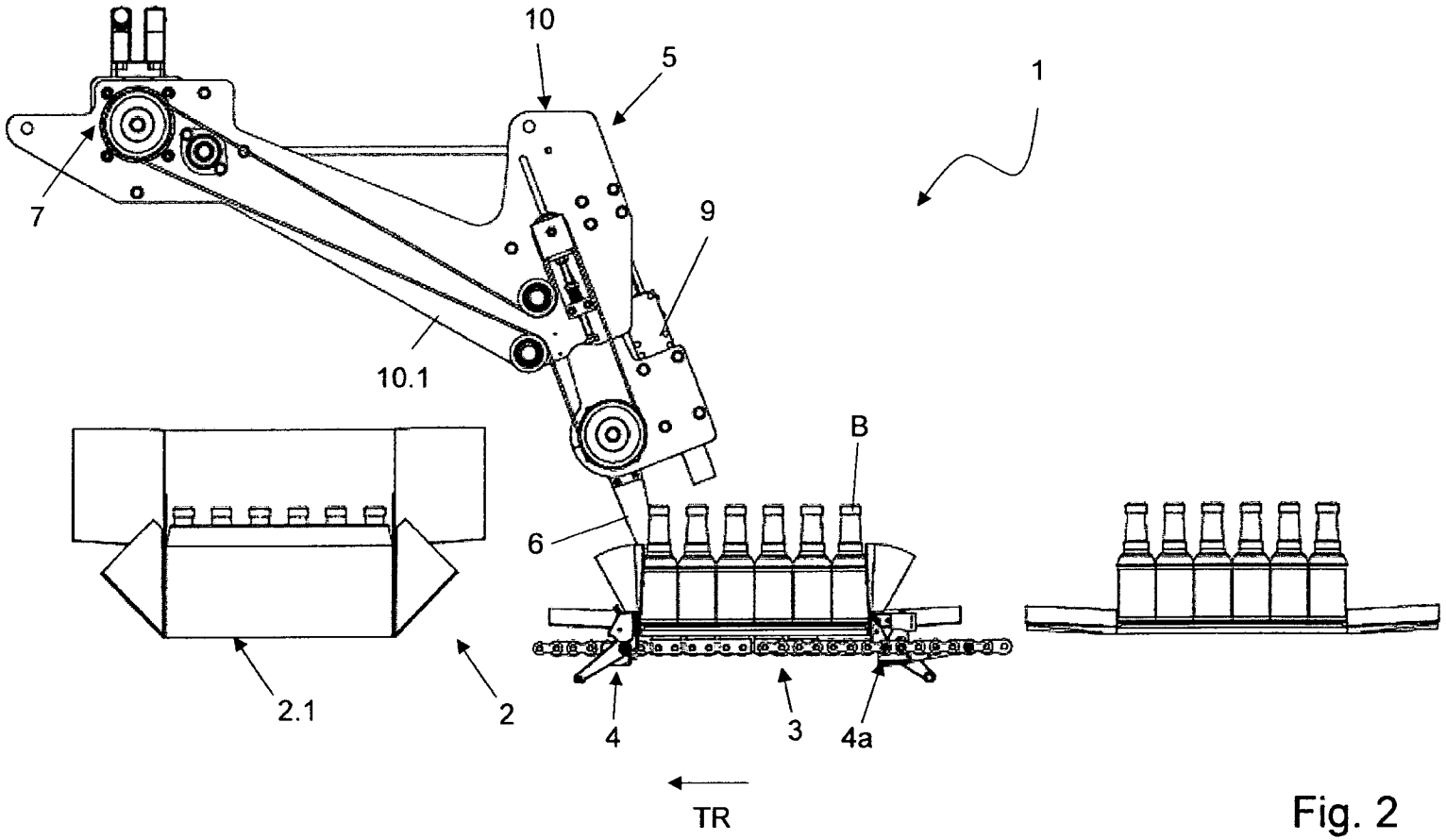
FIG. 2 shows a side view of the folding device of FIG. 1.

In FIGS. 1 and 2, in each case a device 1 according to the invention is shown for the at least partial folding of outer packaging 2. The folding device 1 comprises substantially two device segments: a lower device segment and an upper device segment.

The lower device segment comprises substantially a conveyor device 3 made to move outer packaging 2 supplied as folding blanks. Preferably, by the conveyor device 3, the folding blanks, which consist of multiple segments, in particular a base segment 2.1, together with a multiplicity of containers B arranged in rows standing on the base segment 2.1, are moved in a direction of transport.

The conveyor device 3 is made for the transport of outer packaging 2 of a varying size, i.e. in different formats. The conveyor device 3 preferably has a multiplicity of stop elements spaced apart from each other, against which a particular outer packaging moved on the transport device 3 abuts by its rear edge as seen in the direction-of-transport TR. These stop elements thus form reference points for the position or orientation of the outer packaging 2 on the conveyor device 3.

The conveyor device 3 is designed in particular for transporting wrap-around packaging. Wrap-around packaging of this kind is made to form a closed watertight outer packaging by multiple segments that are connected to each other solely by pre-stamped folds. Thus, no cuts are needed. As a result, at least the lower part of the outer packaging 2, in which a multiplicity of containers B are held, is free of any leakage openings or leakage points.

In particular, the blank forming the outer packaging has a base segment 2.1, a front side segment 2.2, a rear side segment 2.3 and lateral surface segments, 2.4, 2.5. The front side segment 2.2, the rear side segment 2.3 and the lateral surface segments 2.4, 2.5, are connected in an articulated manner to the base segment 2.1 directly by a fold line. Between the front side segment 2.2 and the lateral surface segments 2.4, 2.5 or the rear side segment 2.3 and the lateral surface segments 2.4, 2.5, connecting segments 2.6, 2.7 are provided that, on sides running at right angles to each other, are connected to different segments, for example the front side segment 2.2 and the lateral surface segment 2.4. The connecting segments 2.6 additionally have a fold line 2.6.1 running in a diagonal direction that divides the connecting segment 2.6 into a first and a second connecting segment area 2.6.2, 2.6.3.

In the embodiment shown, the conveyor device 3 has a pair of first folding devices 4, 4' that are provided in the area of the front connecting segments 2.6, seen in the direction of transport TR. The first folding devices 4, 4' are arranged preferably in a swiveling manner on the conveyor device 3 and have at least one contact element that comes to rest opposite the particular connecting segment 2.6.

In the de-activated state of the first folding device 4, 4', this contact area adopts a horizontal position so that, in the de-activated folding device 4, 4', the front side segment 2.2 and the connection segments 2.6 hinged to it are oriented likewise horizontally or substantially horizontally, i.e. are on a level or substantially on a level with the base segment 2.1.

At the position at which the still flat carton blanks are pushed from below onto the transport level, the chain that supports the folding tools also starts. While the folding tools on the deflection shaft appear on the transport level, the front side segments and rear side segments are also oriented in parallel. In the further course of the folding process, the front side segment and rear side segment of the carton blank lie against the folding tool.

The contact surface of the first folding devices 4, 4' can be swiveled in a vertically upright orientation, for example by a lever device, so that the front side segment 2.2 or the connecting segments 2.6 hinged onto it are folded in a direction away from the base segment 2.1 or the conveyor device 3. After the folding by the first folding devices 4, 4', the front side segment 2.2 or the connecting segments 2.6 hinged onto it are folded upwards at a right angle or substantially at a right angle away from the base segment 2.1. The contact elements of the first folding devices 4, 4' thereby lie in each case solely on the connecting segments 2.6., i.e. they do not rest against the front side segment 2.2.

To be able to adapt the device to different formats of outer packaging, the first folding devices 4, 4' can preferably be shifted in the direction of transport or against the direction of transport or can be positioned at different distances from the aforesaid stop element so that a folding of the front side segment 2.2 and the thereby hinged connecting segment 2.6 is possible regardless of the format of the outer packaging 2.

For the further folding of the outer packaging 2, it is necessary to fold the connecting segments 2.6 together along the fold line 2.6.1. so that the two connecting segment areas 2.6.2, 2.6.3 of the connecting segment 2.6 come to rest at least partially against each other in the further folding of the outer packaging 2. To effect this folding along the fold line 2.6.1, by the second device segment arranged above the conveyor device 3, wherein the second device segment is below called the second folding device 5, an application of force on the front side segment 2.2 is exerted, this being where the contact elements of the first folding device 4, 4' rest against the connecting segments 2.6.

In the example of an embodiment shown, the second folding device 5 comprises a supporting device 10 that is made of two supporting device elements 10.1, 10.2 spaced apart from each other. In the lower area of the supporting device 10, a shaft is mounted such that it can rotate about an axis of rotation DA by suitable mounting devices relative to the supporting device 10. The shaft 8 preferably runs parallel to the level at which the outer packaging 2 is moved through the conveyor device 3. Moreover, the shaft 8 preferably runs crosswise to the direction of transport TR of the conveyor device 3, in particular at right angles to the direction of transport TR. The supporting device 10 is arranged apart from the conveyor device 3 in such a way that the shaft 8 is above the containers B that are moved as they stand on the transport device 3. At least one, but in the example of the embodiment shown two, rotating folders 6, 6' are held on the shaft. The rotating folders 6, 6' are set in rotation when the shaft 8 rotates.

A servo-motor 7 is provided on the supporting device 10. The servo-motor 7 is operatively connected to the shaft 8 by suitable driver. In the embodiment shown, the driver is formed by a drive belt. But in other embodiments, the driver can be formed by a chain drive, cogs, etc.

In the exemplary embodiment shown, each of the rotating folders 6, 6' has two diametrically opposite rotating-folder segments 6.1, 6.1'. The rotating-folder segments 6.1, 6.1' are preferably made of flat material. As used herein, flat material refers to a material having a thickness that is small in comparison to the other dimensions of the rotating-folder segments.

The rotating folders 6, 6' are made to be propeller-like. The dimensions of the rotating folders 6, 6' are selected in such a way that, when the shaft 8 is rotated, the rotating-folder segments 6.1, 6.1' standing away from the shaft 8, meet the folded-up front side segment 2.2 above the containers B standing on the base segment 2.1 with their narrow sides and thereby effect a folding-back of this front side segment 2.2, the folding-back being oriented against the direction of action of the first folding devices 4, 4'. The rotating folders 6, 6' preferably act suddenly on the front side segment 2.2 and thereby effect a folding of the connecting segments 2.6 along its particular fold line 2.6.1. This can be seen in particular in FIGS. 1 and 2 on the at least partially folded outer packaging in the direction-of-transport TR after the second folding device 5.

Figure 3:
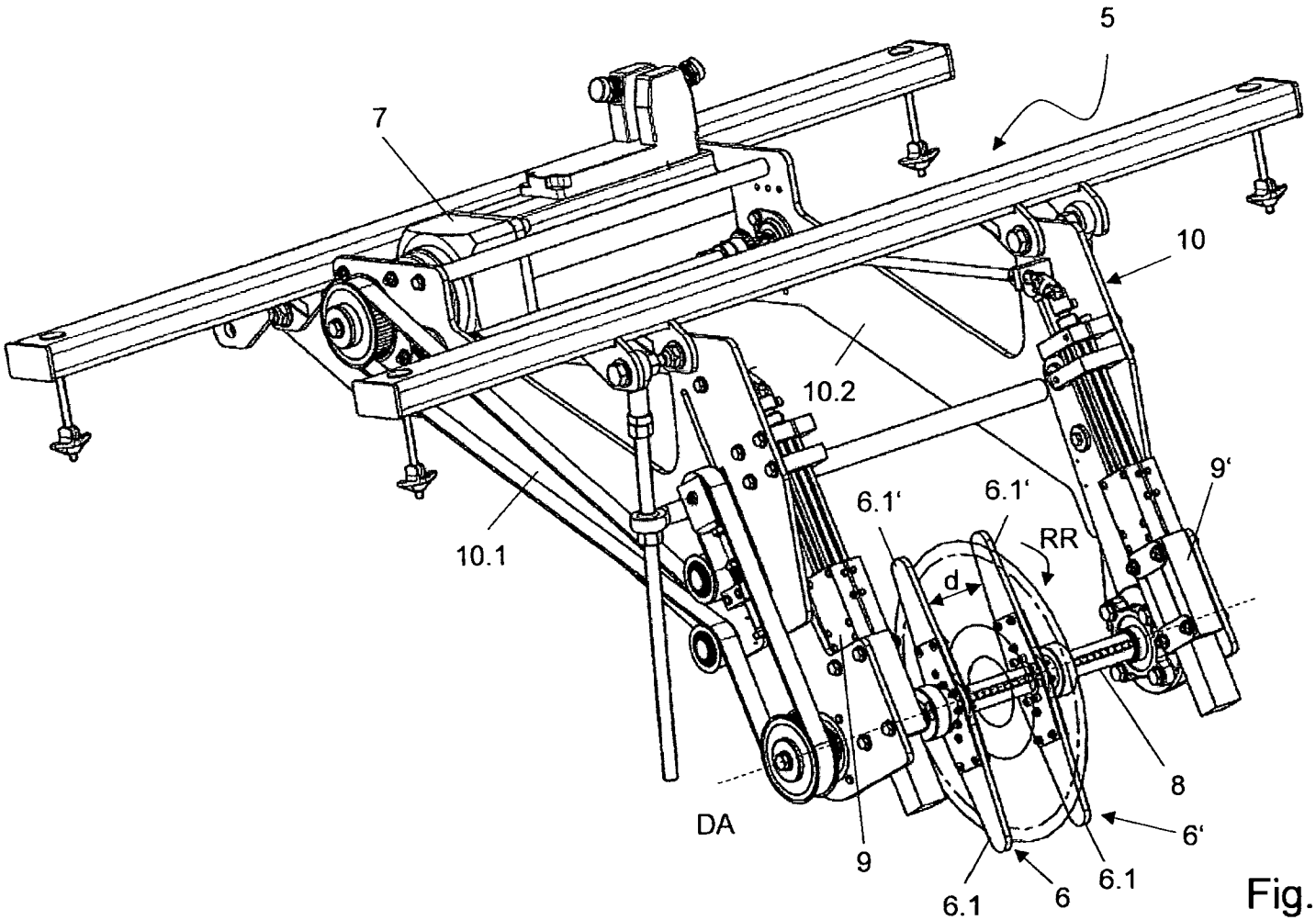
FIG. 3 shows a perspective view of the upper part of the device of FIG. 1.

FIG. 3 shows the second folding device 5 with a greater degree of detail. Two rotating folders 6, 6' arranged independently of each other are arranged in a twist-proof manner on the shaft 8. The particular rotating-folder segments 6.1, 6.1' of the individual rotating folders 6, 6' point in the same direction, i.e. the longitudinal axes of the propeller-like rotating folders 6, 6' and are oriented parallel to each other. To adjust the distance d of the rotating folders 6, 6' to each other or to adjust the distance of the rotating folders 6, 6' to the supporting device elements 10.1, 10.2, the rotating folders 6, 6' are arranged such that they can be shifted on the shaft 8 and can be fixed relative to the shaft 8 by engaging or fixing means, for example a clamping mechanism or catch bolts. Due to this axial mobility, the working width of the second folding device 5 can be adjusted. This enables it to be adapted to different formats of outer packaging or the spacing of the containers B arranged in rows.

To ensure the adjustability of the height of the shaft 8 relative to the conveyor device 3 or the effective depth of the rotating folders 6, 6' relative to the outer packaging 2 transported on the conveyor device 3, the holders or mounting points of the shaft 8 are arranged in a movable manner on the particular supporting device elements 10.1, 10.2.

In the example of an embodiment shown, a spindle drive 9, 9' is allocated to each holding point of the shaft 8. Using the spindle drive, the height of the holding point can be adjusted relative to the conveyor device 3. The two spindle drives 9, 9' are preferably triggered synchronously to each other so that a simultaneous height adjustment of both holding points of the shaft 8 occurs. In this way, a height adjustment of the shaft 8 is achieved in such a manner that it always has a horizontal orientation. Due to the height adjustment of the shaft 8, an adaptation of the folding device 1 to different formats of outer packaging 2 or container formats held in it is possible.

In a preferred embodiment, the folding device 1 is made both for folding the connecting segments 2.6 hinged on the front side segment 2.2 and also the connecting segments 2.7 hinged on the rear side segment 2.3. To achieve this, in the rear area, i.e. on the area adjoining the base segment 2.1 seen in the direction-of-transport 2.1, a first folding device **4*a* is provided. The first folding device 4*a* is made to fold up the rear side segment 2.3 or the connecting segments 2.7 hinged on the rear side segment. To effect a folding of the connecting segments 2.7 along the fold line 2.7.1, it is necessary for the rear side segment 2.3 to be folded in a direction opposite the direction-of-transport TR in the event of the action of the first folding device 4*a* on the connecting segments 2.7. Because of this, the rotating folders 6, 6' can change their direction of rotation RR, i.e. they can be driven clockwise or counter-clockwise. To achieve this, a triggering of the servo-motor 7 occurs in such a manner that it is driven in an alternating, in particular in a chronologically intermittently changing, direction of rotation. As a result, it moves the rotating folders 6, 6' in a direction of rotation RR shown in FIG. 2 (clockwise) to fold the front side segment 2.2 and in the opposite direction (counter-clockwise) to fold the rear side segment 2.3**.

A control system is provided to enable use of the folding device 1 for a multiplicity of different outer packaging formats. The control system interacts with the servo-motor 7 and effects a triggering of the servo-motor 7 optimized for the particular format of the outer packaging 2 and thereby an appropriate rotation of the rotating folders 6, 6' for the particular outer packaging type.

To achieve this, the control system preferably has a memory unit in which at least one set of parameters is saved. This set of parameters includes parameters allocated to the format of the outer packaging 2. This enables the parameters for triggering the servo-motor to depend on the format processed on the folding device 1. The selected parameters effect a triggering of the servo-motor with a desired rotary motion profile that is adapted optimally to the outer packaging format allocated to these parameters, so that the desired folding along the fold lines 2.6.1, 2.7.1 of the connecting segments 2.6, 2.7 is achieved by the action of the rotating folders 6, 6' on the front side segment 2.2 or the rear side segment 2.3 by an optimum speed of impact or an optimum point of impact.

The invention was described above using examples of embodiments. It is clear that a multiplicity of modifications and variations are possible without thereby departing from the inventive idea underlying the invention.

REFERENCE SYMBOL LIST

1 Folding device
2 Outer packaging
2.1 Base segment
2.2 Front side segment
2.3 Rear side segment
2.4 Lateral surface segment
2.5 Lateral surface segment
2.6 Connecting segment:
2.6.1 Fold line
2.6.2 First connecting segment area
2.6.3 Second connecting segment area
2.7 Connecting segment:
2.7.1 Fold line
3 Conveyor device
4, 4' First folding device
**4*a*** First folding device
5 Second folding device
6, 6' Rotating folders
6.1, 6.1' Rotating-folder segment
7 Servo-drive
8 Shaft
9, 9' Spindle drive
10 Supporting device
10.1, 10.2 Supporting device element
B Container
d Distance
DA Axis of rotation
RR Direction of rotation
TR Transport direction

The invention claimed is:

1. An apparatus for at least partially folding outer packaging, wherein said outer packaging has multiple segments connected by fold lines, and wherein said outer packaging has a base segment, said apparatus comprising a conveyor device, a first folding devices, a second folding devices, and a set comprising at least one rotating folder, wherein said conveyor device transports said outer packaging in a direction-of-transport, wherein said conveyor device transports said outer packaging in a position in which at least said base segment of said outer packaging rests on said conveyor device, wherein said first folding devices are arranged on said conveyor device such that said first folding devices swivel, wherein said first folding devices are configured to swivel in a first direction for folding of a front side segment of said outer package that adjoins said base segment of said outer package and connecting segments that are hinged relative to said base segment of said outer package, wherein said second folding devices are provided above said conveyor device, wherein said second folding devices are configured to effect a folding of said connecting segments that are hinged relative to said base segment of said outer package, wherein said second folding devices are configured to act on said front side segment of said outer package in a second direction that is oriented opposite said first direction to fold along a fold line running in said particular connecting segments, wherein said at least one rotating folder is driven to rotate about an axis of rotation, and wherein said second folding devices comprise said at least one rotating folder, wherein said first folding devices and said second folding devices engage opposite sides of said outer packaging.

2. The apparatus of claim 1, further comprising a servo-motor, wherein said servo-motor drives said at least one rotating folder.

3. The apparatus of claim 2, wherein said servo-motor is configured to be triggered with a speed profile that depends on a format of said outer packaging.

4. The apparatus of claim 2, further comprising a control system interacting with said servo-motor, wherein said control system is programmed and configured trigger said servo-motor with an angular acceleration profile that depends on a format of said outer packaging.

5. The apparatus of claim 2, further comprising a control system interacting with said servo-motor, wherein said control system is programmed and configured to trigger said servo-motor with a rotary motion profile that depends on a format of said outer packaging.

6. The apparatus of claim 5, wherein said control system is further configured to change a direction of rotation of said at least one rotating folder.

7. The apparatus of claim 2, wherein said servo-motor is configured to be triggered based on a stored parameter set, said parameter set comprising different format-dependent parameters for triggering said servo-motor.

8. The apparatus of claim 1, further comprising a shaft, wherein said at least one rotating folder is arranged on said shaft, wherein said at least one rotating folder comprises two rotating-folder segments extending radially opposite each other.

9. The apparatus of claim 8, wherein said rotating-folder segments comprise flat material.

10. The apparatus of claim 1, wherein said set comprises at least two rotating folders.

11. The apparatus of claim 10, further comprising a shaft, wherein said rotating folders are arranged on said shaft so that they can be moved axially.

12. The apparatus of claim 10, wherein a distance of said rotating folders relative to said conveyor device is adjustable.

13. A method for at least partially folding outer packaging that has multiple segments connected by fold lines, said method comprising resting a base segment of said outer packaging on a conveyor device; using said conveyor device, moving said outer packaging in a direction-of-transport; swiveling first folding devices, which are arranged to swivel on said conveyor device, in a first direction, thereby folding a front side segment adjoining said base segment and connecting segments hinged on said front side segment relative to said base segment; and using second folding devices that are provided above said conveyor device and that have rotating folders that are driven to rotate about an axis of rotation, folding said connecting segments about a fold line running in said particular connecting segments by acting on said front side segment in a second direction that is oriented against said first direction, wherein said first folding devices and said second folding devices engage opposite sides of said outer packaging.

14. The method of claim 13, further comprising, using a servo-motor, driving said rotating folders.

15. The method of claim 14, further comprising selecting a speed profile that depends on said outer packaging, and driving said rotating folders with said speed profile.

16. The method of claim 14, further comprising selecting an angular acceleration profile that depends on said outer packaging, and driving said rotating fodders with said angular acceleration profile.

17. The method of claim 14, further comprising selecting a rotary motion profile that depends on said outer packaging, and driving said rotating fodders with said rotary motion profile.

18. The method of claim 13, further comprising driving said rotating folders in an alternating direction of rotation.

19. The method of claim 13, further comprising moving said rotating folders at least partially in spaces forming between containers arranged in rows in an area of said base segment of said outer packaging.

* * * * *